US006092773A

United States Patent [19]

Kieliszewski

[11] Patent Number: 6,092,773

[45] Date of Patent: Jul. 25, 2000

[54] RETRIEVABLE CYLINDRICAL WEDGED ANCHOR

[76] Inventor: Randal A. Kieliszewski, 2736 E. 7350 South, Salt Lake City, Utah 84121

[21] Appl. No.: 09/263,611

[22] Filed: Mar. 5, 1999

[51] Int. Cl.[7] ..... A47F 5/08

[52] U.S. Cl. ..... 248/231.9

[58] Field of Search ..... 248/231.9

[56] References Cited

U.S. PATENT DOCUMENTS

| | | | |
|---|---|---|---|
| 4,572,464 | 2/1986 | Phillips | 248/231.9 |
| 4,712,754 | 12/1987 | Brodie | 248/231.9 |
| 4,715,568 | 12/1987 | Best, Jr. | 248/231.9 |
| 4,834,327 | 5/1989 | Byrne | 248/231.9 |
| 5,484,132 | 1/1996 | George et al. | 248/231.9 |

*Primary Examiner*—Leslie A. Braun
*Assistant Examiner*—A. Joseph Wujciak
*Attorney, Agent, or Firm*—Thorpe, North & Western

[57] ABSTRACT

A retrievable rock-climbing anchor for potentially holding a climber to a climbable structure is disclosed. In particular, there is a retrievable rock-climbing anchor that performs better than the prior art. A further feature of the invention is to provide a retrievable rock-climbing anchor, comprising a wedge device having a passive and active wedges; with main and retraction cables coupled at one end to the passive and active wedges respectively. There is also a transverse pull component, fixedly coupled to the retraction cable, and slidably coupled to the main cable, and designed to retract the active wedge by applying a first force thereto, in order to remove the climbing anchor from the climbable structure. There is further a retrieval loop, coupled to a second end of the retraction cable, designed to retract the active wedge and the transverse pull component by applying a second force, which can be larger than the first force, to the retrieval loop.

An additional feature of the invention is to provide a retrievable climbing anchor wherein the retrieval loop comprises an extension of the retraction cable being looped back upon itself; and a swage fixedly coupled to the retraction cable to form a loop.

A further feature of the invention is to provide a retrievable rock-climbing anchor wherein the pull component further comprises a contact face, located on each opposing side of the pull component, which allows the placement of fingers on the sides of the pull component.

17 Claims, 9 Drawing Sheets

RETRIEVABLE CYLINDRICAL WEDGED ANCHOR

BACKGROUND OF THE INVENTION

1. Field of the Invention

This invention relates to retrievable rock-climbing anchors. In particular, it is a spring-loaded reusable wedge anchor, having both finger-pressure and carabiner removal means, for insertion into crevices or drilled holes in rock faces which performs better than those taught in the prior art.

2. Description of the Related Art

The prior art shows various types of retrievable rock-climbing anchors which are used as a belay for climbers and then removed when no longer needed and saved for later reuse. Examples of patents related to the present invention are as follows, each of which is herein incorporated by reference for its supporting teachings:

U.S. Pat. No. 4,572,464 is an artificial chock stone for use by rock climbers to provide a protection point. The chock comprises a pair of slidably engaged wedges which are adjustable between a large dimension and a small dimension upon relative sliding of the wedges, which are biased to a large dimension. The device may be inserted and provide a secure protection point in a narrow, smooth-walled, paralleled-sided crevice and is constructed to provide a point of attachment to which a safety line may be secured.

U.S. Pat. No. 4,712,754 is an anchoring device for releasably anchoring within a crack in a rock face, the crack having a pair of opposed crack walls. The device has a cam member, a load cable, and expansion and retraction structure. The cam member has convexly curved cam surfaces which contact respective walls of the crack. An inner end portion of the load cable cooperates with the cam member, and an outer end portion of the cable has a loop to cooperate with a separate link or rope. An intermediate portion of the cable cooperates with shoulders of the cam member in such a manner as to rotate the cam member in first direction when the cable is pulled. This increases force acting on the crack walls and augments retention of the device within the crack. The expansion structure automatically rotates the cam member in the first direction, thus tending to initiate retention of the device within the crack. The retraction structure rotates the cam member in a second direction, opposite to the first direction, so as to decrease force on the crack walls, thus facilitating removal of the device from the crack. The invention provides a simple mechanical device which is easy to insert and remove from the crack and is particularly adapted for fitting within cracks having essentially parallel crack walls. The device is relatively insensitive to off-axis forces, which are prone to damage some prior art structures having rigid load carrying members.

U.S. Pat. No. 4,715,568 is a wedge plate with a substantially planar, rock-engaging surface and a friction surface converging with the rock-engaging surface at a non-overhauling angle to define a thick end portion of the wedge plate. A flexible tube or frame is secured to the thick end portion of the wedge plate and extends away therefrom. A body has a surface one portion of which is engageable with a rock surface and the other portion of which slidably engages the friction surface of the wedge plate. A flexible wire extends through or alongside the flexible tube or frame. The wire and tube or frame is severally connected to the wedge plate and to the body. Individual hand grips on the tube or frame and wire permit manual sliding of the wire in the tube or frame and corresponding sliding of the body and the wedge plate. A spring opposes such sliding in one direction. A climbing line connection is joined to the wire.

U.S. Pat. No. 4,834,327 discloses a self-adjusting climbing chock which includes a main cable structure having a looped end and first and second cable end sections. A fixed wedge element is joined to the cable end sections, and one of the fixed wedge element faces is provided with a tapered depression. A translating wedge element, having a bearing surface which is complementary to the sliding surface of the depression, may be manually retracted against a compression spring between a first position at which the combined thickness of the fixed and translating wedge elements exceeds the maximum thickness of the fixed wedge element and a second position in which the combined thickness does not exceed the maximum thickness of the fixed wedge element. Thus, the adjustable climbing chock may be inserted into a crevice simultaneously with finger actuation of a transverse pull component to configure the wedge end of the chock into the insertion position such that subsequent release of the transverse pull component results in the spring returning the translating wedge element to a position between the first and second positions which is variable according to the thickness of the crevice at that point. In order to obtain a chock which is capable of accommodating to irregular inner crevice surfaces, the translating wedge element is preferably a spherical section cooperating with an inside cylindrical section depression. Embodiments employing a plurality of translating wedge elements are also disclosed.

U.S. Pat. No. 5,484,132 is an expansible head safety climbing chock which has a three-part expansible head with an arcuate outer circumference and teeth extending around the circumference of both the wedge-type expansible head pieces and the inner end of a rigid body through which the safety rope or cable passes to the largest head piece. The expansible head safety chock is designed to be used in drilled holes in rock faces from which it is easily removed during non-use for aesthetic and safety reasons.

The foregoing patents reflect the state of the art of which the applicant is aware and are tendered with a view toward discharging applicant's acknowledged duty of candor in disclosing information that may be pertinent in the examination of the application. It is respectfully stipulated, however, that none of these patents teach or render obvious, singly or when considered in combination, applicant's claimed invention.

3. Problems with the Prior Art

In previous years, rock-climbing has become a highly popular and increasingly common sport. In it, climbers utilize safety ropes to belay them against sudden falls or to aid them in maneuvering around on a rock face. These safety ropes were historically removably attached to the rock face by pitons and/or rock bolts which were permanently attached to the rock. These fixed anchors became offensive to many outdoors enthusiasts and environmentalists due to their permanent nature and their tendency to corrode when exposed to the elements, often leaving stains on the rock which caused considerable detriment to the scenic and aesthetic worth of the rock face itself.

Such concerns prompted the move by many climbers toward the use of the "clean climb" technique, which relied upon removable and reusable climbing aids to enable climbers to scale a rock face without installing permanent attachments. These devices are used in either existing cracks in the rock or prepared orifices, and are meant to be removed when not needed.

Many of these devices have suffered from poor removability, however, thus leaving many permanently embedded in rock faces and causing the staining and degradation noted above. This is due in large part to their dependence on finger-pressure as their sole means of removal from the rock face. Thus, when the anchors become firmly embedded in the face, if finger pressure is insufficient to remove them, they must be abandoned in place, thus causing the corrosion and staining mentioned above, while also becoming an additional expense to the climber and posing a risk to anyone attempting to use them in the future.

Further, if a climber attempts to remove the anchors by force by using means other than finger-pressure, such as by attaching carabiners or other devices to the pull components to give better leverage or grip, the increased stress on the cable components of the anchors would often cause them to separate from the pull components, thus similarly leaving them permanently embedded in the rock.

In addition, many retrievable anchors are unable to provide an adequate protection point in shallow drill holes. Among the reasons for this was the long length of the anchor segment of the anchor, and the corresponding need of the anchor for sufficient depth in order to be engaged properly. Many anchors thus could not provide a safe and secure anchor point in drill holes as shallow as ½ inch in depth.

There is thus a need for a retrievable anchor that offers additional means to facilitate its removal from the rock when it becomes tightly wedged, which allows for the use of greater forces on the active members of the anchor while avoiding separation of the control/anchoring cables from the pull components, and which are able to provide a secure anchor point in drill holes that are shallow.

SUMMARY OF THE INVENTION

It is a feature of the invention to provide a retrievable rock-climbing anchor for potentially holding a climber to a climbable structure. In particular, there is a retrievable rock-climbing anchor that performs better than the prior art.

A further feature of the invention is to provide a retrievable rock-climbing anchor, comprising a wedge device having a passive and active wedges; with main and retraction cables coupled at one end to the passive and active wedges respectively. There is also a transverse pull component, fixedly coupled to the retraction cable, and slidably coupled to the main cable, and designed to retract the active wedge by applying a first force thereto, in order to remove the climbing anchor from the climbable structure. There is further a retrieval loop, coupled to a second end of the retraction cable, designed to retract the active wedge and the transverse pull component by applying a second force, which can be larger than the first force, to the retrieval loop.

An additional feature of the invention is to provide a retrievable climbing anchor wherein the retrieval loop comprises an extension of the retraction cable being looped back upon itself; and a swage fixedly coupled to the retraction cable to form a loop.

A further feature of the invention is to provide a retrievable rock-climbing anchor wherein the pull component further comprises a contact face, located on each opposing side of the pull component, which allows the placement of fingers on the sides of the pull component.

The invention resides not in any one of these features per se, but rather in the particular combination of all of them herein disclosed and claimed, and it is distinguished from the prior art in this particular combination of all of its structures for the functions specified.

There has thus been outlined, rather broadly, the more important features of the invention so that the detailed description thereof that follows may be better understood, and so that the present contribution to the art may be better appreciated. There are, of course, additional features of the invention that will be described hereinafter which would form the subject matter of the claims appended hereto. Those who are skilled in the art will appreciate that the conception, upon which this disclosure is based, may readily be utilized as a basis for the designing of other structures, methods, and systems for carrying out the several purposes of the present invention. It is important, therefore, that the claims are regarded as including such equivalent constructions insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, neither is it intended to be limiting as to the scope of the invention in any way.

Other features of the present invention will become clearer from the following detailed description of the invention, taken with the accompanying drawings and claims, or may be learned by the practice of the invention.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings. Like numbering used on different drawings represents like elements.

Charter by the U.S. Constitution

This disclosure of the invention is submitted in furtherance of the constitutional purposes of the United States Patent Laws "to promote the progress of science and useful arts," as stated in Article 1, Section 8 of the United States Constitution.

DETAILED DESCRIPTION OF THE PREFERRED EMBODIMENT

Figure 1:
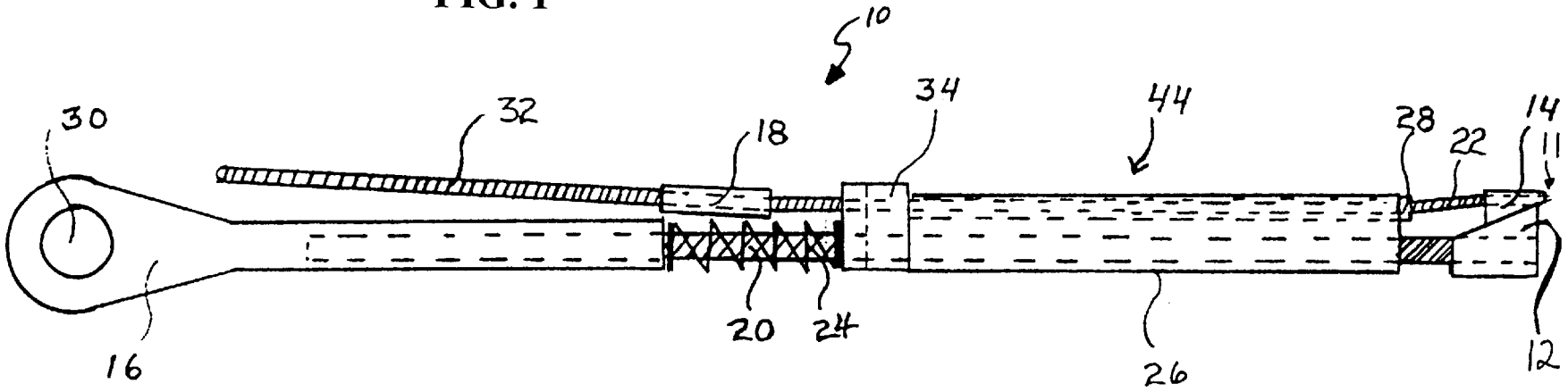
FIG. 1 is a side view of the retrievable wedged anchor in its actuated mode.
Figure 2:
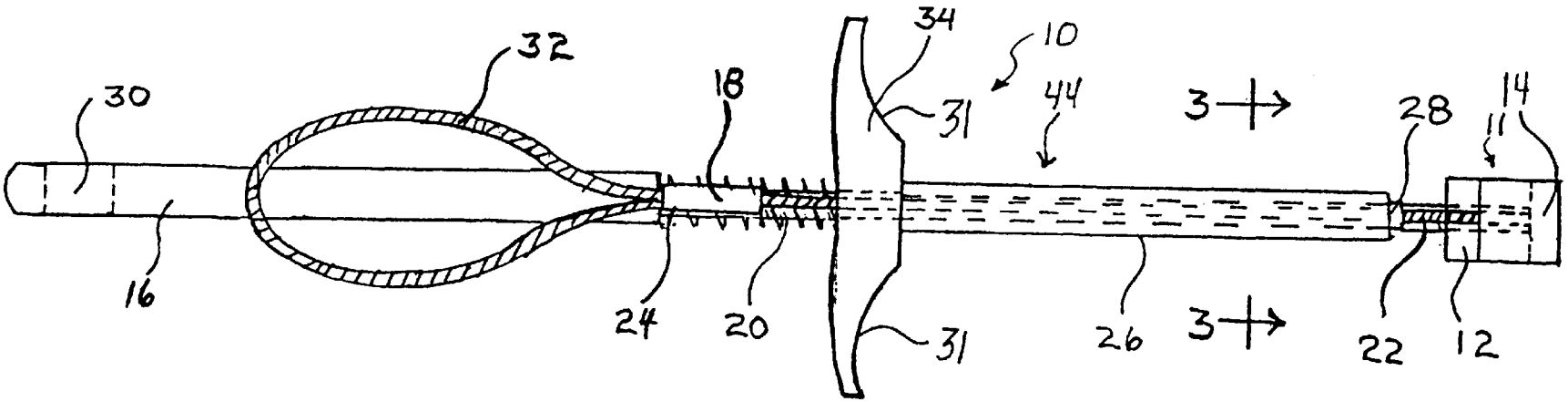
FIG. 2 is a top view of the embodiment of FIG. 1.

Referring to both FIG. 1 and FIG. 2, there are side and top views (respectively) of a retrievable wedged anchor in its actuated mode. Specifically, there is a retrievable wedged anchor 10, made up of an anchor segment 11, flexible tubular body portion 44, transverse pull component 34 ("pull component"), retrieval loop 32, and eyelet attachment point 16. FIGS. 1–4 also show large outer sheath 26, inner small sheath 28, retracting cable 22, main cable 20, compression spring 24, swage 18, and aperture 30.

Figure 3:
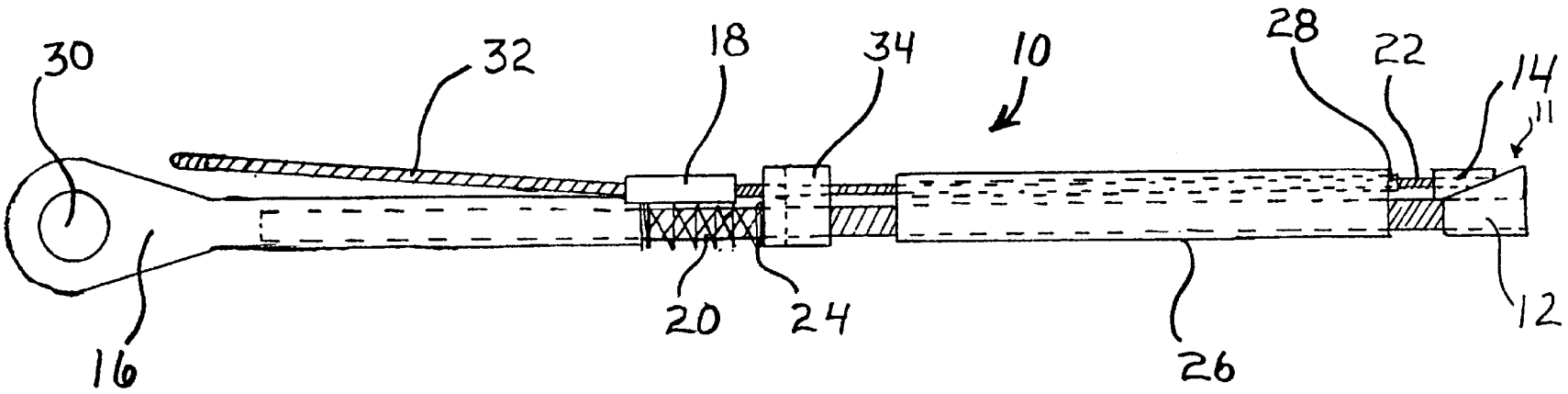
FIG. 3 is a side view of the retrievable wedged anchor of FIG. 1 in its retrievable mode.
Figure 4:
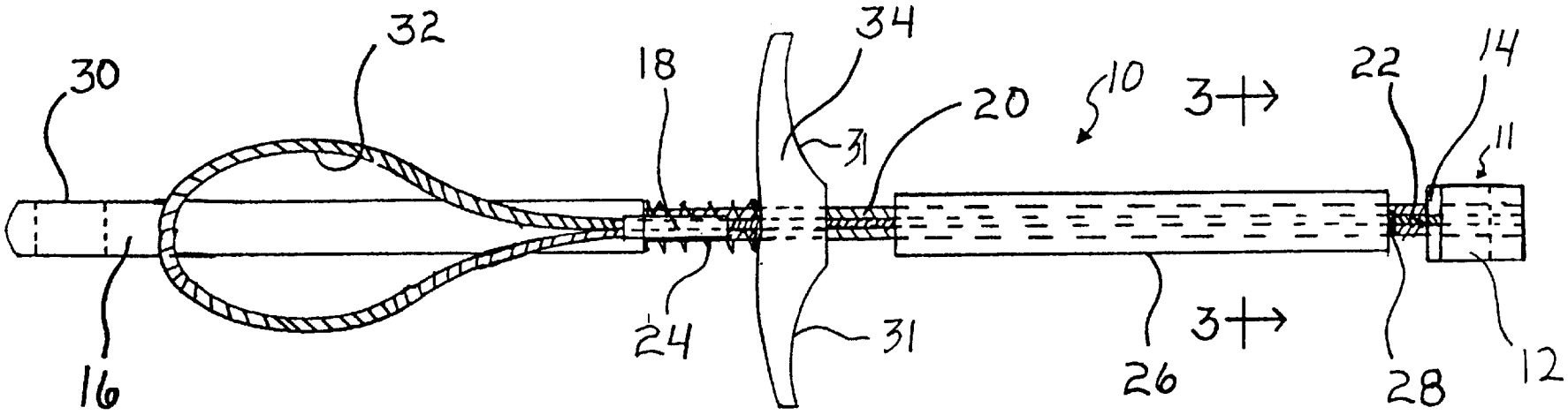
FIG. 4 is a top view of the embodiment of FIG. 3.

FIG. 3 and FIG. 4 differ from FIG. 1 and FIG. 2 in that the device is shown in the retrievable configuration, with pull component 34 retracted against compression spring 24, by means of pull component 34 or retrieval loop 32, thus displacing active wedge element 14.

Figure 5:
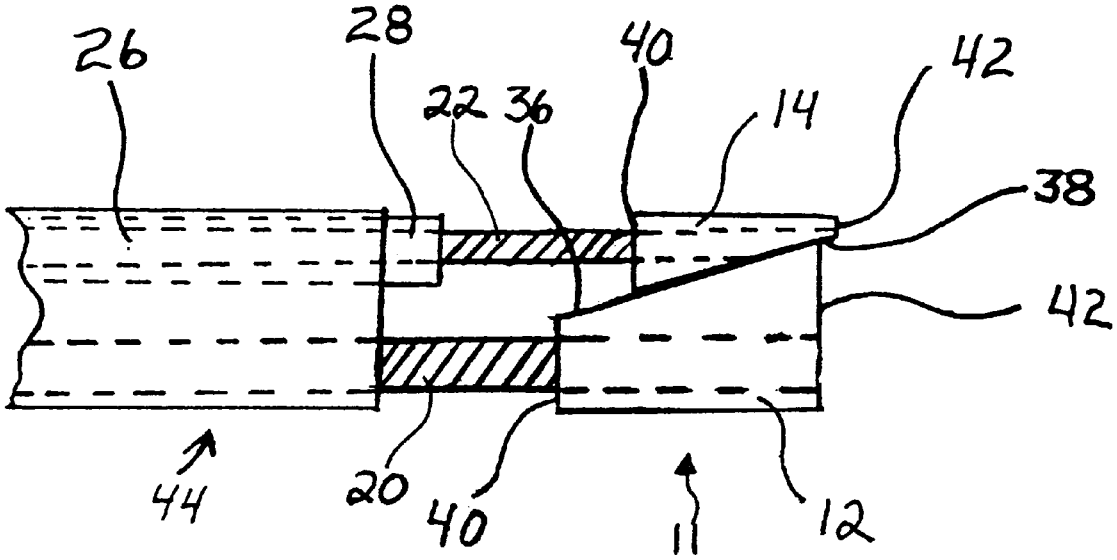
FIG. 5 is an enlarged side view of FIG. 1 of the anchor segment of the retrievable wedged anchor in its actuated mode.

FIG. 5 is an enlarged detailed view of the anchor segment of the retrievable wedged anchor. The anchor segment comprises passive wedge element 12, active wedge element 14, main cable 20, and retracting cable 22. Wedges 12 and 14 are designed so as to be in slidable contact with each other when actuated within a crevice. Wedges 12 and 14 have oppositely-angled inclined planes 36 and 38, respectively, which, when actuated, increase the diameter of the composite anchor segment. Wedges 12 and 14 further both have inner ends 40 and outer ends 42.

Figure 7:
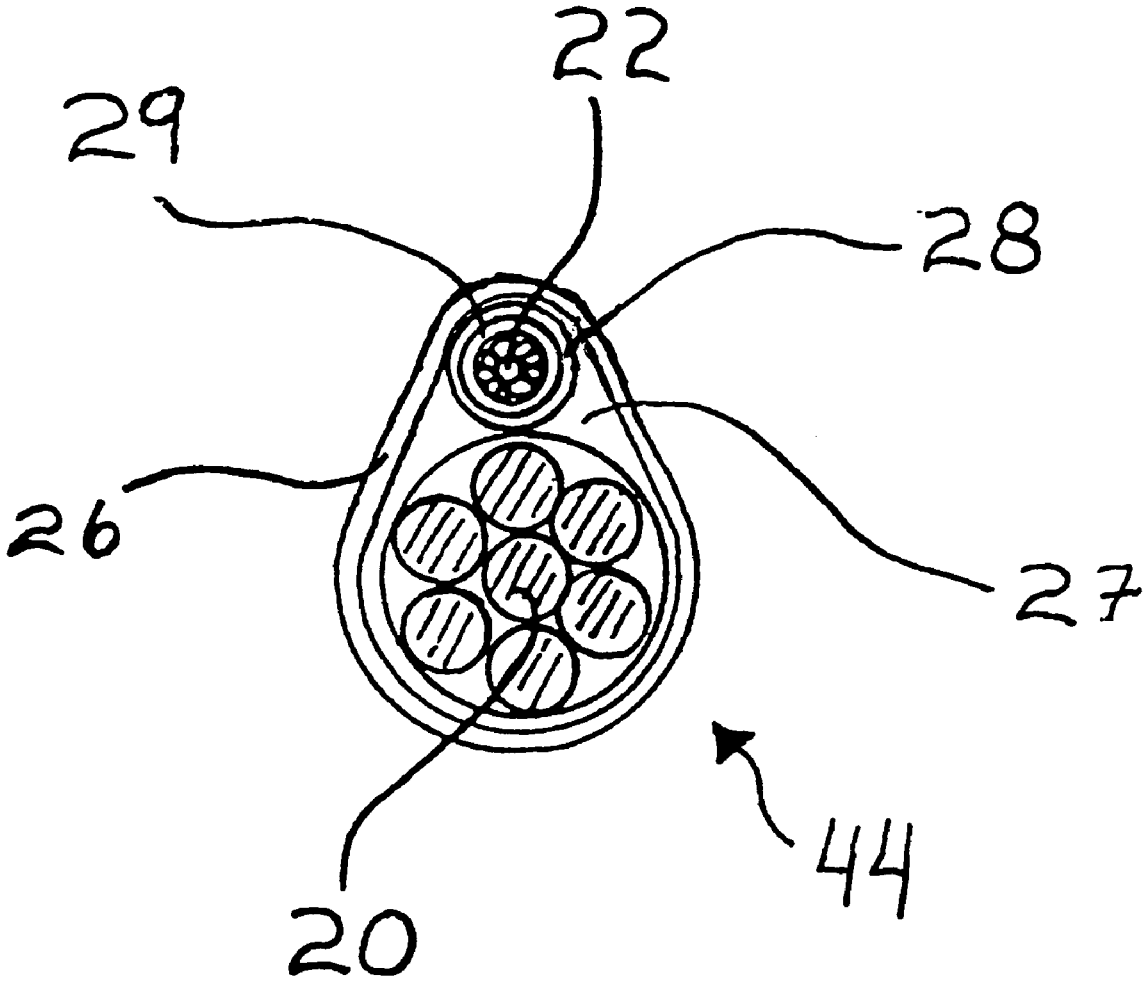
FIG. 7 is an enlarged cross-sectional view of the flexible body portion of the retrievable wedged anchor taken generally along the line of 3—3 of FIG. 2 and FIG. 4.

Referring now to FIG. 5 and FIG. 7 (which is a cross-sectional view of FIG. 2 or FIG. 4 at 3), wedge component 12 is fixedly attached to main cable 20, which travels fixedly through the flexible tubular body portion 44 and slidably through pull component 34, and is finally fixedly attached to eyelet attachment point 16. Wedge component 14 is fixedly attached to retracting cable 22, which travels slidably through the inner small sheath component 28 of flexible tubular body portion 44 and fixedly through pull component 34, after which it is doubled back upon itself to form retrieval loop 32.

Flexible tubular body portion 44 comprises outer large sheath 26, and inner small sheath 28. The outer large sheath encapsulates main cable 20 and inner small sheath 28, which encapsulates retracting cable 22. Outer large sheath 26 creates hollow chamber 27, through which main cable 20 and inner small sheath 28 travel. Inner small sheath 28 creates hollow chamber 29, through which retracting cable 22 travels. In the preferred embodiment, the outer large sheath is composed of a heat-shrink rubber material, and the inner small sheath is composed of Teflon tubing.

Figure 6:
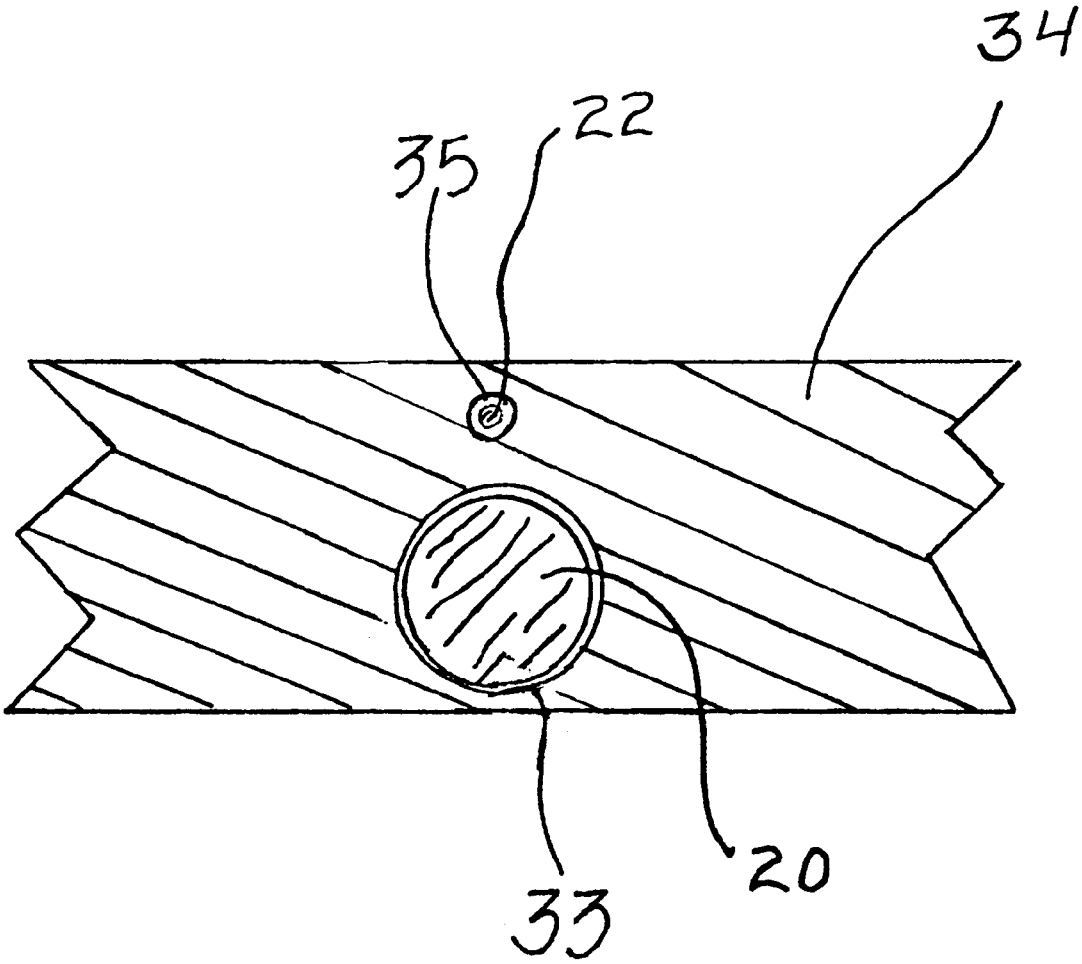
FIG. 6 is an enlarged cross-sectional view of the transverse pull component of FIG. 1 and FIG. 2.

Referring to FIG. 6, there is a partial diagram of pull component 34, from FIGS. 1–4. This pull component 34 is located intermediate to the anchor segment 11 and the eyelet attachment point 16, which is also referred to as the web attachment device, having the aperture 30 formed therein. This pull component comprises a set of contact faces 31, which allow easy application of finger-pressure to the pull component. This pull component contains a pair of bores: bore 33 passes through the center of pull component 34, and bore 35 is located between bore 33 and the top edge of the pull component. Main cable 20 passes slidably through bore 33, and retracting cable 22 passes through bore 35, to which it is affixed by punching or other similarly effective means.

As seen in FIGS. 1–4, a yieldable biasing means in the form of compression spring 24 abuts pull component 34 and eyelet attachment means 16. This spring is threaded onto main cable 20. Further, after traveling fixedly through pull component 34, retrieval cable 22 is swaged back upon itself by swage 18, thus forming retrieval loop 32. Finally, eyelet attachment means 16 has an aperture 30, through which a very strong nylon webbing (not shown) is attached to form a loop which may receive a carabiner or other similar means.

Figure 8:
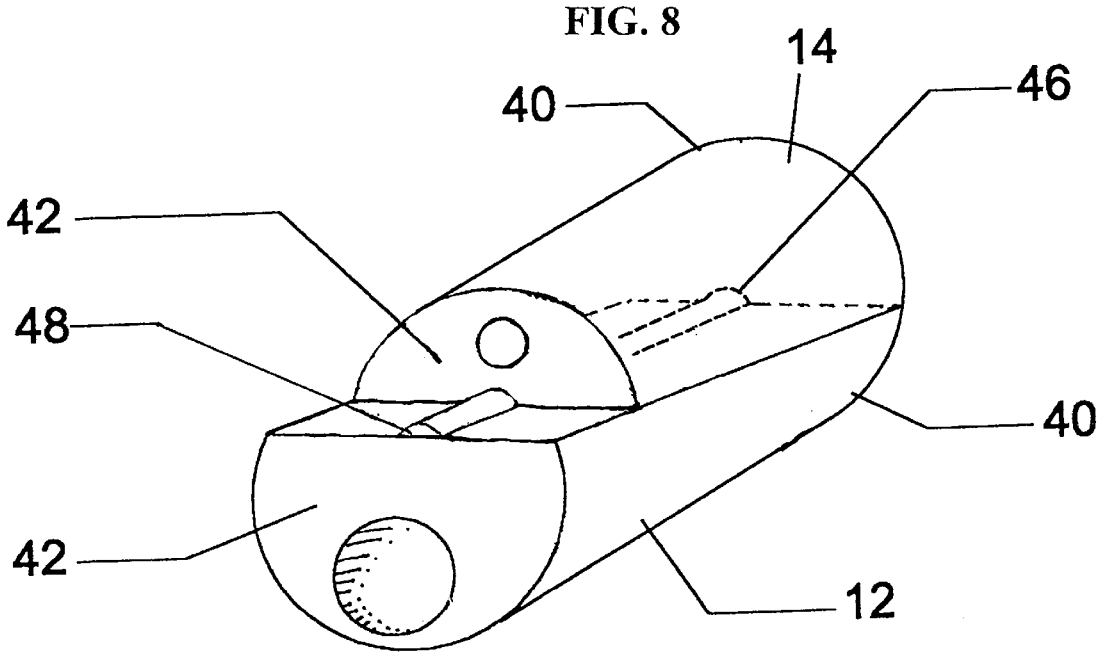
FIG. 8 is an enlarged isometric view of an alternate embodiment of the active and passive wedge components of the anchor segment of a retrievable wedged anchor.
Figure 9:
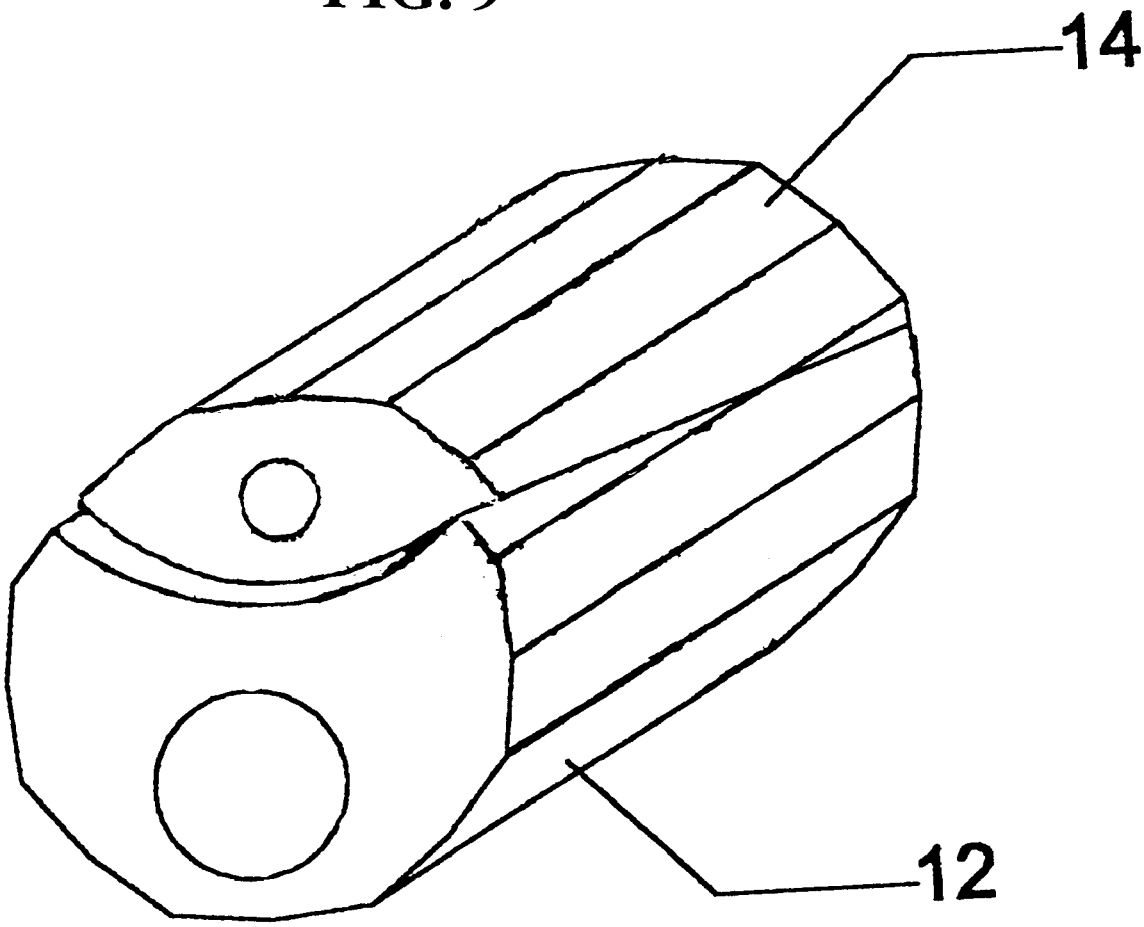
FIG. 9 is an enlarged isometric view of a second alternate embodiment of the active and passive wedge components of the anchor segment of a retrievable wedged anchor.

FIGS. 8 and 9 show alternate embodiments of the anchor segment, including concave grooves 46 and slides 48 to aid in maintaining the alignment of the wedges while in use.

Remarks about the Preferred Embodiment

One of ordinary skill in the art of designing rock-climbing equipment will realize many advantages from using the preferred embodiment. First, a skilled artisan would appreciate the property of the preferred embodiment to change the overall cross-sectional dimensions of the anchor segment. Compression spring 24 is oriented so as to force pull component 34 away from eyelet attachment point 16. This action also forces active wedge element 14 toward overtaking wedge element 12, thus giving a greater circumference to the anchor segment, anchoring the device into crevices or holes in the rock face. This use is denoted as actuation. The anchor is made retrievable by applying pressure against the pressure faces of the pull component, thus compressing the compression spring, retracting active wedge element 14, and narrowing the circumference of the anchor segment, thus allowing the anchor to be retrieved from a crevice or hole in a rock face.

Further, when deployed, any force transmitted to eyelet attachment point 16 would further tend to force the anchor segment to its largest dimension, thus securing the anchor increasingly strongly. The anchor of the invention has been tested to withstand a vertical force of 2800 pounds. Once the anchor is in place, a carabiner is attached to the strong nylon strap (not shown) inserted through aperture 30 of eyelet attachment point 16, which may then be used as a protection point, a belay anchor, a rappel anchor, or an attachment means.

Since all known prior art teaches only one way of extracting positioned anchor units, the advantages of a second means of extracting such units when firmly wedged into the rock will be apparent to a skilled artisan. Anchor units may become very firmly wedged into the rock face when force is applied to them, as when they arrest the fall of or aid in arresting the fall of a climber. In the past, mere finger pressure has often been insufficient to free such units. As seen in the preferred embodiment, retrieval loop 32 allows the application of larger amounts of force to the pull component, and thus the active wedge element, thus allowing more effective removal. This force may be provided by attaching a carabiner to the retrieval loop 32 and using, for example, either a slide hammer, greater hand pressure, or other pressure to affect removal of the anchor.

In much of the prior art, retracting cables such as that of 22 are attached solely to pull components such as 34. As a result, the application of strong pressure upon the pull components, as by pulling with a carabiner, for example, could cause dissociation of the cable from the pull component, rendering the anchor irretrievable. Since in the disclosed invention retrieval loop 32 is fixed directly to active anchor component 14 in addition to being attached to pull component 34, it will not come loose. This allows the application of stronger pressures to the anchor by means, such as, for example, carabiners or slide hammers.

Finally, since active wedge element 14 does not need to pass outer end 42 to reach the diameter of a drill hole, the anchor may be used in drill holes as shallow as ½ inch.

Variations of the Invention

A skilled artisan would consider it an obvious design change to use different configurations of the anchor segment, using conical, acicular, mammilated or other shapes.

Further, the retrieval loop could also have a ball stop, with which a tool could be used to aid in extraction. Additionally, the need to couple the retraction cable to the pull component could be avoided by putting a small swage stop adjacent to the pull component. Further, the wedges could be composed of many different types of materials, including, but not limited to, resins, plastics, alloys, etc. The wedges could also vary in hardness, coarseness, and texture. The wedges could also be constructed with a concave groove 46 through the inclined plane on one wedge, and a slide 48 to fit the groove on the complementary wedge, as seen in FIGS. 8 and 9. This design would help to keep the wedges aligned. In addition, the wedges could be magnetized to hold them in alignment, or the perimeter of the wedges could be faceted and still achieve the necessary circumference of drilled round holes. Further, cables of greater thickness could be used as retracting cable 22 and thus retrieval loop 32.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Patent is:

1. A retrievable wedged climbing anchor, for potentially holding a climber to a climbable structure, comprising:

a) a wedge device (11), having a passive (12) and active (14) wedge;

b) a main (20) cable coupled at one end to the passive wedge;

c) a retraction (22) cable coupled at one end to the active wedge;

d) a transverse pull component (34), fixedly coupled to the retraction cable, and slidably coupled to the main cable, and designed to retract the active wedge by applying a first force thereto, in order to remove the climbing anchor from the climbable structure;

e) a retrieval loop (32), coupled to a second end of the retraction cable, designed to retract the active wedge and the transverse pull component by applying a second force to the retrieval loop; and f) wherein the passive wedge remains stationary while the active wedge is moved relative to the passive wedge by movement of the retraction cable that is caused by either applying the first force to the transverse pull component or the second force to the retrieval loop.

2. The anchor of claim 1, wherein the retrieval loop comprises:

a) an extension of the retraction cable being looped back upon itself; and b) a swage (18) fixedly coupled to the retraction cable to form a loop.

3. The anchor of claim 1, wherein the pull component further comprises:

a) a contact face (31), located on each opposing side of the pull component, which allows the placement of fingers on the sides of the pull component.

4. The anchor of claim 1, wherein the pull component further comprises a first bore (33), passing through a center region of the pull component, through which the main cable slidably passes.

5. The anchor of claim 1, wherein the pull component further comprises:

a second bore (35), passing through the pull component, having the retracting cable affixed therethrough.

6. The anchor of claim 1, further comprising a flexible tubular body, having:

a) an outer sheath (26), rigidly attached about the main cable; and b) an inner sheath (28), positioned about the retracting cable to allow the retracting cable to slidably pass through the inner sheath.

7. The anchor of claim 6, further comprising:

a web attachment device, fixedly coupled to another end of the main cable, and having an aperture (30) formed therein.

8. The anchor of claim 7, further comprising:

a bias device, coupled around the main cable and located between the transverse pull component and the web attachment device.

9. The anchor of claim 1, wherein the passive and active wedges have comformally mated surfaces.

10. A retrievable wedged climbing anchor, for potentially holding a climber to a climbable structure, comprising:

a) a wedge device (11), having a passive (12) and active (14) wedge;

b) a main (20) cable coupled at one end to the passive wedge;

c) a retraction (22) cable coupled at one end to the active wedge;

d) pull means (34), fixedly coupled to the retraction cable, and slidably coupled to the main cable, for pulling the active wedge by applying a first force thereto, in order to remove the climbing anchor from the climbable structure;

e) retrieval means (32), coupled to a second end of the retraction cable, for retrieving the active wedge and the pull means by applying a second force to the retrieval loop; and f) wherein the passive wedge remains stationary while the active wedge is moved relative to the passive wedge by movement of the retraction cable that is caused by either applying the first force to the pull means or the second force to the retrieval means.

11. The anchor of claim 10, wherein the retrieval means comprises:

a) an extension of the retraction cable being looped back upon itself; and b) a swage (18) fixedly coupled to the retraction cable to form a loop.

12. The anchor of claim 10, wherein the pull means further comprises:

a) a contact face (31), located on each opposing side of the pull means, which allows the placement of fingers on the sides of the pull means.

13. The anchor of claim 10, wherein the pull means further comprises:

a first bore (33), passing through a center region of the pull means, through which the main cable slidably passes.

14. The anchor of claim 13, wherein the pull means further comprises:

a second bore (35), passing through the pull means, having the retracting cable affixed therethrough.

15. The anchor of claim 10, further comprising: a flexible tubular body, having:

a) an outer sheath (26), rigidly attached about the main cable; and b) an inner sheath (28), positioned about the retracting cable to allow the retracting cable to slidably pass through the inner sheath.

16. The anchor of claim 15, further comprising:

a web attachment device, fixedly coupled to another end of the main cable, and having an aperture (30) formed therein.

17. The anchor of claim 15, further comprising:

a bias device, coupled around the main cable and located between the pull means and the web attachment device.

* * * * *